United States Patent [19]

Sterling et al.

[11] 4,288,999

[45] Sep. 15, 1981

[54] APPARATUS TO LESSEN THE ENTANGLEMENT OF TUBULAR FABRICS

[75] Inventors: Larry D. Sterling; Wilbert Melvin, Jr., both of Dover, Del.

[73] Assignee: International Playtex, Inc., Stamford, Conn.

[21] Appl. No.: 8,986

[22] Filed: Feb. 5, 1979

[51] Int. Cl.[3] ..... D06B 23/00; B65B 11/58; B65B 67/08

[52] U.S. Cl. ..... 68/13 R; 53/449; 53/592

[58] Field of Search ..... 8/150; 68/13 R, 235 R; 26/80; 100/12; 53/449, 592; 24/16 R, 17 B, 18; 206/303, 304

[56] References Cited

U.S. PATENT DOCUMENTS

| | | | |
|---|---|---|---|
| 1,488,748 | 4/1924 | Fetherolf | 8/150 X |
| 1,937,544 | 12/1933 | Cameron et al. | 8/150 X |
| 2,020,170 | 11/1935 | Borroughs | 8/150 X |
| 2,183,876 | 12/1939 | Sullivan | 206/303 X |
| 3,139,814 | 7/1964 | Sanders | 100/12 X |

FOREIGN PATENT DOCUMENTS

| | | | |
|---|---|---|---|
| 514885 | 12/1930 | Fed. Rep. of Germany | 8/150 |

*Primary Examiner*—Philip R. Coe
*Attorney, Agent, or Firm*—Stewart J. Fried

[57] ABSTRACT

A means for lessening the entanglement of a tubular extent of fabric by inserting a hoop into a collapsed stack of that fabric prior to its being subjected to processing steps which heretofore have resulted in the entanglement and knotting of tubular fabric to a hoop inserter; inserting a flexible length within the tubular fabric so that it extends outward from the two ends thereof; securing the distal ends of the flexible length outward of the tubular fabric extent so as to form a hoop; processing the tubular extent with the hoop in place; preferably in a porous bag; opening the hoop and securing one end to an anchor; and reorienting the tubular extent to a substantially planar flattened extent, employing the now opened hoop as a guide, and finally removing the opened hoop from the tubular fabric.

8 Claims, 5 Drawing Figures

APPARATUS TO LESSEN THE ENTANGLEMENT OF TUBULAR FABRICS

The present invention relates to an apparatus to lessen the entanglement of tubular fabrics.

In processing knitted tubular fabrics, many of the finishing procedures, such as scouring, dyeing and the like, cause the tubular fabric to become severely entangled upon itself. The present invention significantly reduces the entanglement and knotting which would otherwise accompany these finishing steps and thereby significantly reduces the labor entailed in processing the fabric. Due to the minimizing of the tangling problems, the finished fabric is less distorted and of better overall quality.

One of the common procedures in processing circular knit tubular fabric, especially fine gauge and/or lightweight fabric, is to emplace a length of the tubular knit fabric into porous bags and, as bagged, subject the fabric to scouring, dyeing and drying processes. While the bag serves to lessen the degree of stretching and distortion of the fabric, there is still a significant degree of twisting and knotting of the fabric upon itself.

When the fabric is removed from the bag, workers have to spend substantial time to untangle and unknot the fabric so that it is properly laid out to be slit for use or otherwise rolled onto spools for shipment. This handling often stretches the fabric and can have an adverse effect on the overall quality of the finished fabric.

While the need for a solution to this problem has existed for many years, where equipment has been designed to overcome it, the equipment has been adapted to non-bagging operations and is relatively expensive and complex.

For example, U.S. Pat. No. 3,882,577 to Aranoff, provides an apparatus for handling tubular fabrics and provides a pair of rings which have arm extensions which can pivot and engage the inner surface of the tubular fabric so as to untwist the processed tubular fabric back to its original loop stage. Other prior workers describe devises such as floating frames within the tubular fabric which are attached to relatively complex mechanical equipment to aid in the untangling process. See, for example, U.S. Pat. No. 2,110,520 to Cunnius and Parkes U.S. Pat. No. 1,141,833. However, where relatively delicate fabrics are being processed, bagging is desirable and the complex untangling equipment cannot be readily employed.

According to the present invention, a relatively inexpensive arrangement is provided which permits bagging and eliminates the need for complex pieces of equipment. The present invention provides means to enable a hoop of an endless flexible length to engage the fabric and maintain it in a collapsed state prior to bagging, and which hoop when opened, provides a guide for the laying out of the processed fabric. The hoop is engaged within the length of tubular fabric by inserting a length of preferably flexible material such as a string or a cord within the tubular extent of the fabric; having the ends of the length exit both orifices of the tubular extent; causing these ends to meet and be tied off so as to form an endless, longitudinally extending flexible hoop engaging the tubular extent of fabric for maintaining the tubular extent of fabric in a collapsed state.

The preferred apparatus for the emplacement of the hoop within the tubular extent generally comprises; a feeding mechanism to feed the tubular fabric to the hooping apparatus, an endless length emplacement apparatus and preferably means to facilitate the bagging as soon as the hooping has been completed.

In addition, it is also preferable that the post processing laying out of the fabric be done at a work station which provides means to open the hoop and secure one end thereof to an anchor, with the opposite end of the now open hoop serving as a guide for the laying out of the fabric.

Thus, in its preferred form, the present invention provides the means to deliver an extent of tubular fabric to a hoop inserter; inserting a flexible length within the tubular fabric so that it extends outward from the two ends thereof; securing the distal ends of the flexible length outward of the tubular fabric extent so as to form a hoop; processing the tubular extent with the hoop in place; opening the hoop and securing one end of the hoop to an anchor; and reorienting the tubular extent to a substantially planar flattened extent employing the now opened hoop as a guide and removing the opened hoop from the tubular fabric.

BRIEF DESCRIPTION OF THE DRAWINGS

Having thus generally described the background and nature of the present invention, the invention and its operation may be better understood through the description of the preferred embodiment through reference to the accompanying figures in which.

DESCRIPTION OF THE PREFERRED EMBODIMENT

Figure 4:
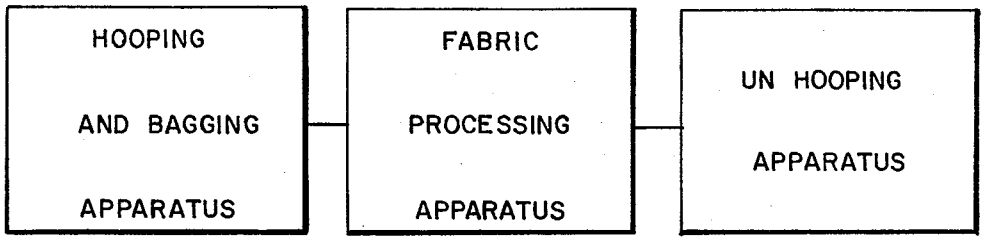
FIG. 4 is a block diagram of the total process of the present invention.

The overall process, as illustrated in FIG. 4, includes an apparatus for securing a hoop about a collapsed tubular extent of fabric and bagging the same, apparatus for processing the bagged, collapsed and hooped tubular extent of fabric and apparatus for unbagging and removing the hoop. The hoop securing and bagging apparatus is illustrated in detail in FIGS. 1, 2 and 2A. The processing apparatuses are well known and may include scouring, dyeing and drying. The hoop removing apparatus may include the apparatus of FIG. 3.

Figure 1:
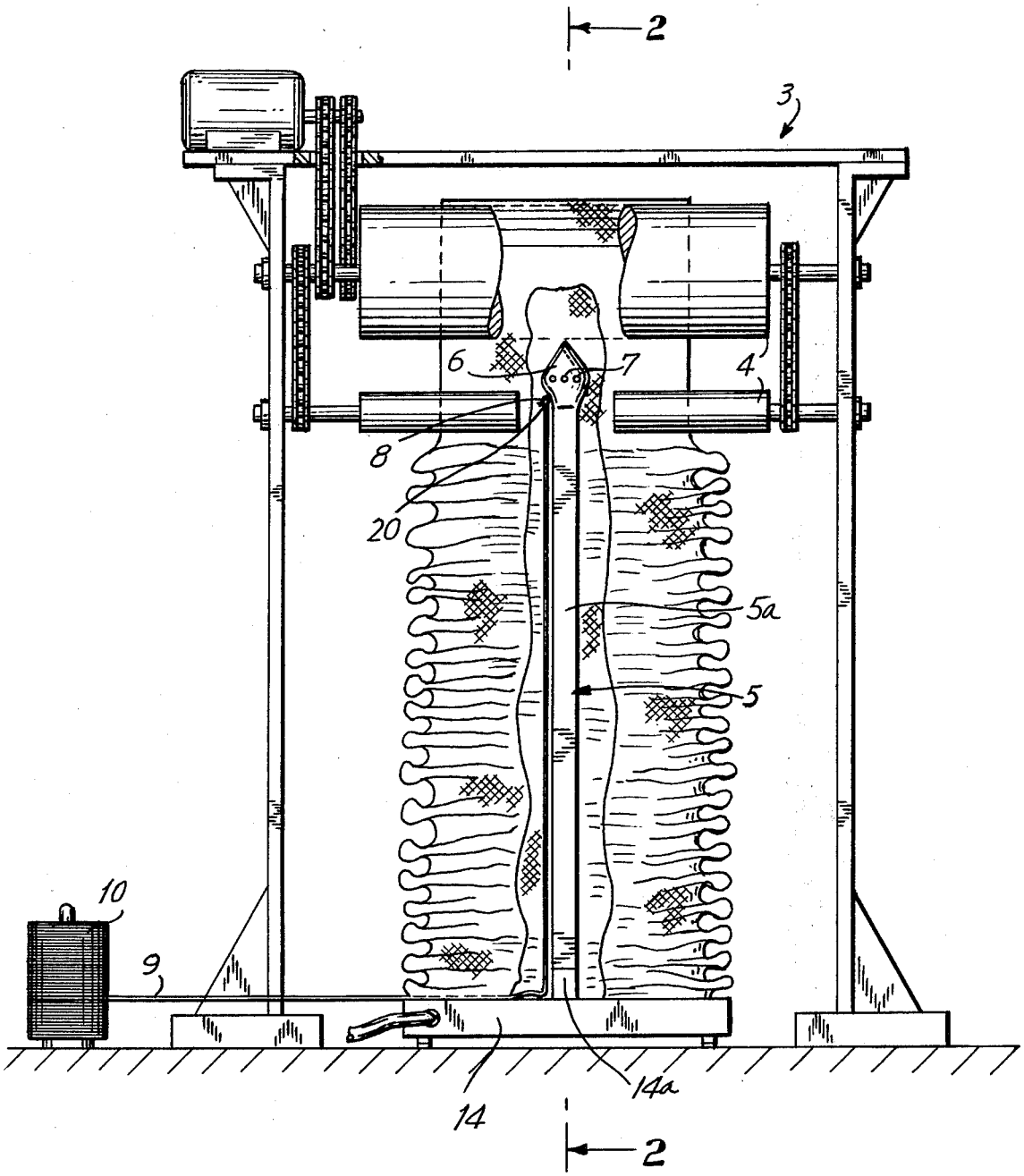
FIG. 1 is a front elevation, partially broken away, of a preferred apparatus of the present invention.
Figure 2:
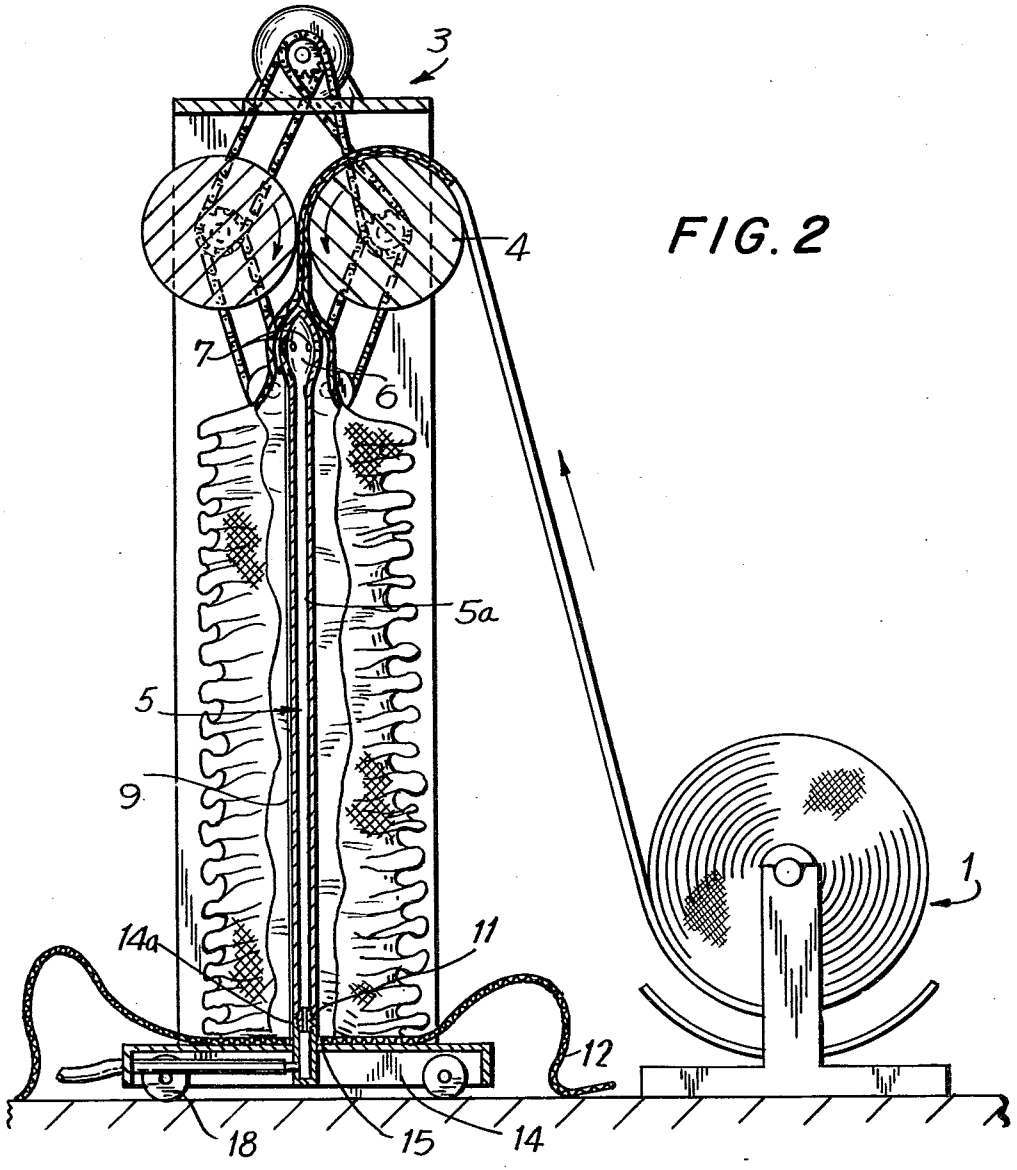
FIG. 2 is a sectional view of the apparatus of FIG. 1 taken along lines 2—2 thereof.

Referring now to the drawing, like numbers refer to like parts in the various figures. As shown in FIGS. 1 and 2, a roll 1 of tubular fabric 2 is fed to the hooping station 3 by feed rolls 4 which can be an integral part of the hooping apparatus or separately provided.

The preferred hooping station includes a hooping apparatus 5 having a vertically oriented elongated hollow tubular member 5*a* which has a generally triangular head portion 6 at its upper end. By having the elongated tubular member 5*a* oriented in the vertical direction, the tubular fabric can fit about it, with the fabric as fed thereover being able to readily collapse about the elongated tubular member 5*a* and form a toroid.

To enable the tubular fabric 2 to feed smoothly over the elongated tubular member 5*a* and to permit the ready insertion of a flexible length therein, the tubular member 5*a* preferably includes a hollow chamber and openings 7 outward of the hollow chamber. A stream of air preferably under a degree of pressure is then fed to the head through the hollow elongated tubular member 5*a* so that the stream of air urges the fabric away from the triangular head 6. The fabric is therefore in a somewhat partially opened condition as it passes over the triangular head 6. This eases the feeding of a fabric over the triangular head 6.

The triangular head 6 on the elongated tubular member 5*a* includes a retention portion 8 for the flexible length. This is shown in the drawing as a tieing off ring, but it can be any convenient mounting arrangement to which a flexible length such as string or otherwise can be secured and later untied. Attached to the flexible length retention member 8 is one end 20 of the flexible length 9 which is illustrated in the drawings as string. The flexible length 9 extends along the height of the elongated tubular member 5*a* to the base 14 and is fed from a spool 10 or other source.

Preferably, the elongated tubular member 5*a* is selected so as to be of a height so that the head 6 will protrude above the collapsed stack of tubular fabric 2 which is going to be processed. This permits the ease of attachment of the flexible length and later removal of the hooped fabric.

Once the desired length of tubular fabric 2 has been fed over the triangular head 6, the flexible length is severed from the spool 10 and the severed end 21 (shown in FIG. 2*a*) is brought into proximity to the secured end 20 on the triangular head 6, and the secured end 20 is attached to the severed end 21, so that the collapsed stack of tubular fabric has a hoop of flexible length about it. The hoop of flexible length tends to retain the collapsed stack in a toroidal or donut shape. As hooped, the fabric is then emplaced in the processing bag and the final processing operations such as scouring, dyeing and drying can be accomplished.

In its preferred form, the hooping station of the present invention provides the means for facilitating the bagging operation. As shown in FIG. 1, the vertically aligned, elongated tubular member 5*a* may be affixed to a movable base 14 in a manner which readily permits the withdrawal of the elongated tubular member 5*a* from the base 14. One illustrated affixation means is by thread fitting 11 of the elongated tubular member 5*a* to the base 14. This can be further facilitated by having a mated, relatively short vertical coupling 14*a* vertically mounted on the base 14. A porous bag 12 can be placed over the base 14 prior to the feeding of the tubular fabric 2. The bag would include a small bottom opening 15 which would permit it to fit over the threaded coupling 14*a* to mate with the elongated tubular member 5*a*. This opening in the bag 15 does not weaken the integrity of the bag nor hamper its operation in the final processing of the tubular fabric.

Once the length of tubular fabric 2 has been oriented in a collapsed stack about the elongated tubular member 5*a*, the movable base 14, shown as being one having rollers 18, can be moved away from other apparatus of the hooping station 3. This removes any obstruction which might impede the removal of the elongated tubular member 5*a* from the base 14.

Figure 2A:
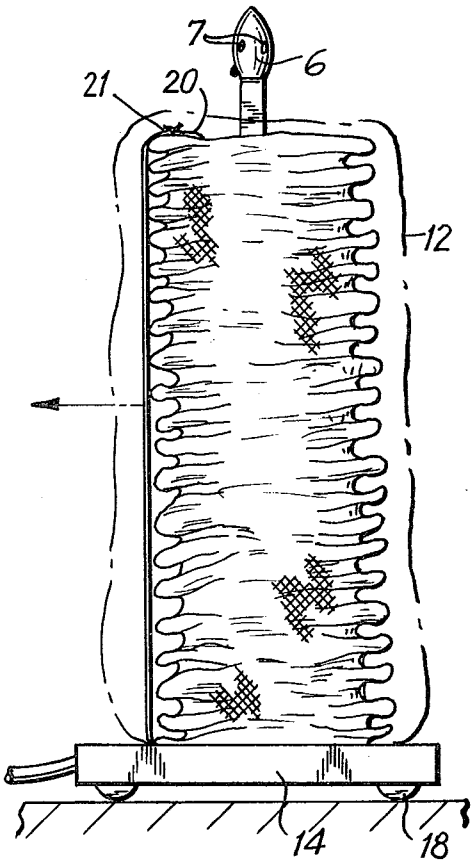
FIG. 2*a* is a side elevation of a portion of the apparatus of FIG. 2.

This is shown in FIG. 2*a* which illustrates the connected ends 20, 21 forming the hoop; the elongated tubular member 5*a* as it is removed from the base 14; and the bag 12 brought up and about the collapsed stack of tubular material 2. The bag is secured closed such as by tying or otherwise.

Figure 3:
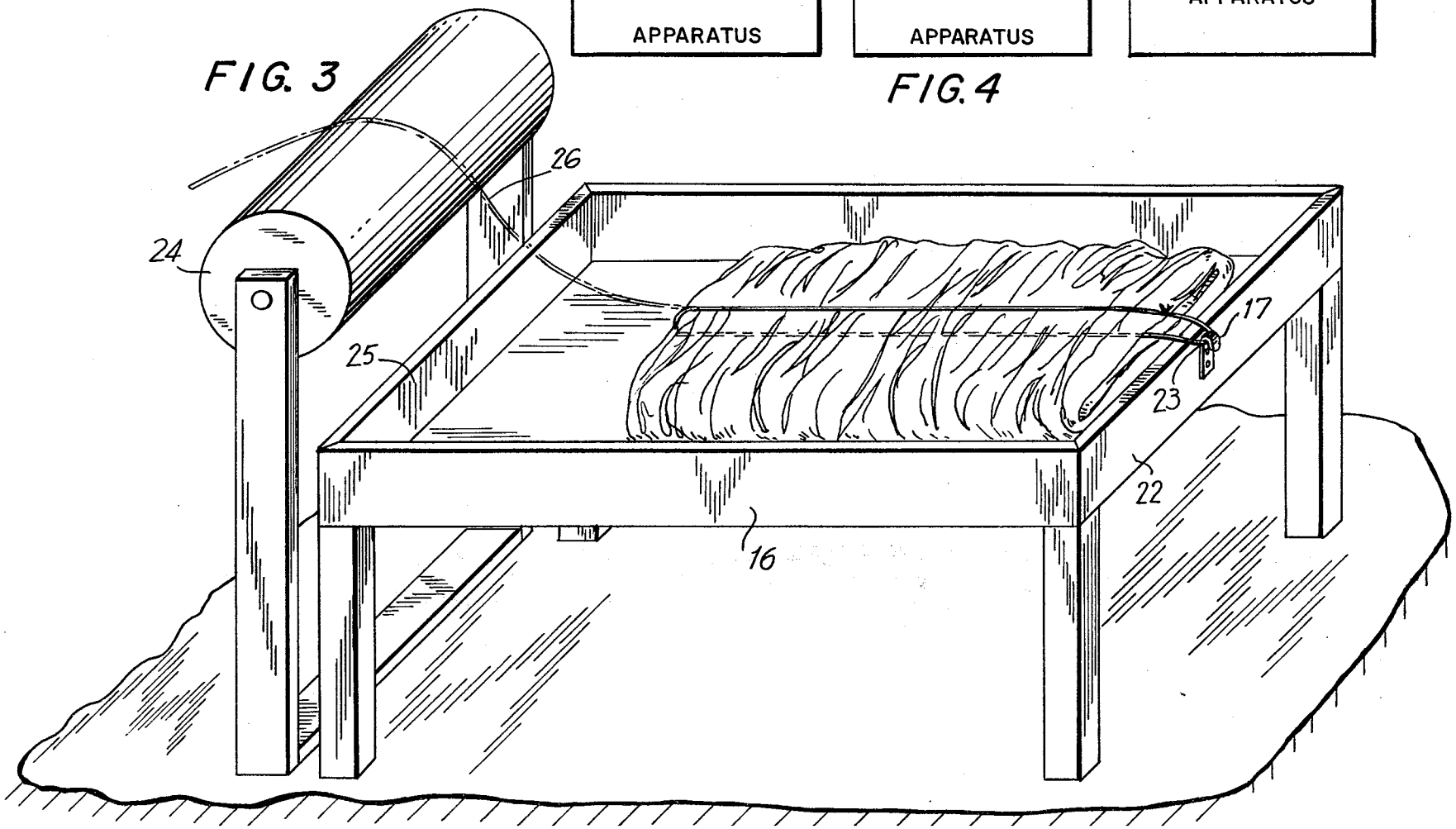
FIG. 3 is a perspective view of a preferred work station for the reorientation of the fabric and the removal of the hoop.

After the completion of those processing steps which require bagging, the fabric is removed from the bag and placed on a work table 16 such as that illustrated in FIG. 3. While any shape work table can be employed, it is preferable that a generally rectilinear table having a smooth surface be used. The surface should be large enough to accommodate a substantial portion of the fabric as it would be in the laid out flat condition.

As shown in FIG. 3, the hooped tubular extent of fabric is placed on the work table 16 with one of the open ends of the tube of the fabric parallel to one of the shorter sides of 22 of the rectangle. The hoop is located and severed. One end of the now opened hoop (designated as 23) is secured to an anchor 17 which is preferably located on side 22. The other end 26 of the flexible length (shown in phantom in FIG. 3) is placed over a guide roller 24 which is preferably mounted adjacent along the side 25 of the work table parallel to side 22. The opened hoop serves as a guide for the feeding out of the tubular fabric from its toroidal stack to a relatively flat, untangled length of fabric. Slitting or further handling of the fabric can now be easily accomplished.

Even allowing for the cost of the hooping apparatus and the labor involved in hooping, the practice of the present invention significantly reduces the total time required for the processing of the fabric. Further, only one worker is required for both hoop emplacement and removal step. With the lesser incidence of tangling and knotting, the quality of the finished fabric is improved.

While the invention has been shown, illustrated, described, and disclosed in terms of embodiments or modifications, the scope of the invention should not be deemed to be limited by the precise embodiment or modification herein shown, illustrated, described and disclosed. For example, the shape of the head 6 on the elongated tubular member 5*a* may, of course, vary as may the means of securement of the elongated tubular member 5*a* to the base 14. These are only two illustrations where alternative embodiments will readily suggest themselves to one skilled in the art, yet fall within the scope of the claims which are hereinafter appended.

What we claim is:

1. An apparatus for preparing a tubular extent of fabric for processing comprising:

hoop inserter means for positioning a length of hooping material along an axis; and means for continuously delivering a tubular extent of fabric axially along the axis of said hoop inserter means to form a collapsed donut-shaped tubular extent of fabric about said length of hooping material;

said hoop inserter means and hooping material having a length sufficient for the ends of said hooping material to extend from both ends of said collapsed tubular extent of fabric so that said ends of said hooping material can be joined to form an endless hoop about said collapsed donut-shaped tubular extent of fabric for lessening the entanglement of said tubular extent of fabric during subsequent fabric treatment processing.

2. The apparatus as claimed in claim 1 wherein said hoop inserter means includes a vertically oriented member and means on said vertically oriented member to removably secure a portion of said length of hooping material adjacent the top of said vertically oriented member.

3. The apparatus as claimed in claim 2 wherein said vertically oriented member includes a head portion, and said head portion includes means to partially open said tubular extent of fabric as it passes over said head portion.

4. The apparatus as claimed in claim 3 wherein said head portion includes a hollow chamber therein and openings outward of said hollow chamber and means to deliver a stream of air to said hollow chamber and outward therefrom through said openings.

5. The apparatus as claimed in claim 4 wherein said vertically oriented member is hollow and said stream of air is delivered therethrough to said head portion.

6. The apparatus as claimed in claim 1 including a base means extending radially from one end of said hoop inserter means for supporting a bag into which said tubular extent of fabric is collected in a collapsed, donut shape.

7. The apparatus as claimed in claim 6 wherein said hoop inserter means has a vertical axis, said base means is horizontal and said hooper inserter means is removably mounted to said base means.

8. The apparatus as claimed in claim 1 including means for processing said collapsed donut-shaped tubular extent of fabric, and means for removing said endless hoop from said collapsed donut-shaped tubular extent of fabric after processing.

* * * * *